US008344300B2

(12) United States Patent
Nasman

(10) Patent No.: US 8,344,300 B2
(45) Date of Patent: Jan. 1, 2013

(54) DEVICE TO REDUCE SHADOWING DURING RADIATIVE HEATING OF A SUBSTRATE

(75) Inventor: Ronald Nasman, Averill Park, NY (US)

(73) Assignee: Tokyo Electron Limited (JP)

( * ) Notice: Subject to any disclaimer, the term of this patent is extended or adjusted under 35 U.S.C. 154(b) by 318 days.

(21) Appl. No.: 12/815,261

(22) Filed: Jun. 14, 2010

(65) Prior Publication Data

US 2011/0303654 A1 Dec. 15, 2011

(51) Int. Cl.
*H05B 6/64* (2006.01)

(52) U.S. Cl. ..... 219/678; 219/118; 219/634; 438/746; 438/680

(58) Field of Classification Search ..... 219/118, 219/618, 600, 627, 634, 678, 686; 438/680, 438/746
See application file for complete search history.

(56) References Cited

U.S. PATENT DOCUMENTS 6,951,821 B2 * 10/2005 Hamelin et al. ..... 438/706
7,253,448 B2 * 8/2007 Roberts et al. ..... 257/99
7,952,049 B2 * 5/2011 Tsukamoto ..... 219/121.58
8,194,384 B2 * 6/2012 Nasman et al. ..... 361/234

* cited by examiner

*Primary Examiner* — David Nhu

(57) ABSTRACT

A substrate heating apparatus configured to be coupled to a processing system and radiatively heat a substrate is described. The substrate heating apparatus includes a radiative heat source coupled to a processing system and configured to produce electromagnetic (EM) radiation, a translucent object positioned between the radiative heat source and the substrate along a the EM radiation path, and an opaque object also positioned between the radiative heat source and the substrate along the EM radiation path. The translucent object includes at least one textured surface to cause random refraction of the EM radiation passing through the translucent object, or an optical waveguide configured to encapsulate the opaque object and direct the EM radiation around the opaque object, or both, to prevent creation of a shadow of the opaque object on the substrate.

20 Claims, 9 Drawing Sheets

DEVICE TO REDUCE SHADOWING DURING RADIATIVE HEATING OF A SUBSTRATE

BACKGROUND OF THE INVENTION

1. Field of Invention

The invention relates to a substrate heating apparatus configured to be coupled to a processing system, and more particularly to a substrate heating apparatus configured to radiatively heat a substrate with reduced shadowing.

2. Description of Related Art

It is known in semiconductor manufacturing and processing that various processes, including for example etch and deposition processes, depend significantly on the temperature of the substrate. For this reason, the ability to control the temperature of a substrate and, more specifically, uniformly control the temperature of the substrate is becoming an essential requirement of a semiconductor processing system. The temperature of a substrate is determined by many thermal interactions including, but not limited to, thermal exchange between a substrate and a substrate holder, thermal exchange between the substrate and its surrounding environment including other components of the processing system, thermal exchange between the substrate and/or substrate holder and the heat source(s) or sink(s) used to heat or cool the substrate and/or substrate holder, etc. Providing a proper temperature to the upper surface of the substrate holder may be utilized to control the temperature of the substrate.

SUMMARY OF THE INVENTION

The invention relates to a substrate heating apparatus configured to be coupled to a processing system, and more particularly to a substrate heating apparatus configured to radiatively heat a substrate with reduced shadowing.

According to one embodiment, a substrate heating apparatus configured to be coupled to a processing system and radiatively heat a substrate is described. The substrate heating apparatus comprises a radiative heat source coupled to a processing system and configured to produce electromagnetic (EM) radiation, a translucent object disposed between the radiative heat source and the substrate along an EM wave path there between, and an opaque object disposed between the radiative heat source and the substrate along the EM wave path there between. The translucent object comprises at least one textured surface to cause random refraction of the EM radiation passing through the translucent object, or an optical waveguide configured to encapsulate the opaque object and direct the EM radiation around the opaque object, or a combination thereof.

According to another embodiment, a processing system is described. The processing system comprises a process chamber, a susceptor coupled to the process chamber and configured to support a substrate, a substrate heating apparatus coupled to the processing system and configured to radiatively heat the substrate, and a gas distribution system configured to introduce a process gas to the process chamber to facilitate film forming reactions at a surface of the substrate. The substrate heating apparatus comprises a radiative heat source coupled to a processing system and configured to produce electromagnetic (EM) radiation, a translucent object disposed between the radiative heat source and the substrate along an EM wave path there between, and an opaque object disposed between the radiative heat source and the substrate along the EM wave path there between. The translucent object comprises at least one textured surface to cause random refraction of the EM radiation passing through the translucent object, or an optical waveguide configured to encapsulate the opaque object and direct the EM radiation around the opaque object, or a combination thereof.

DETAILED DESCRIPTION OF SEVERAL EMBODIMENTS

Figure 1:
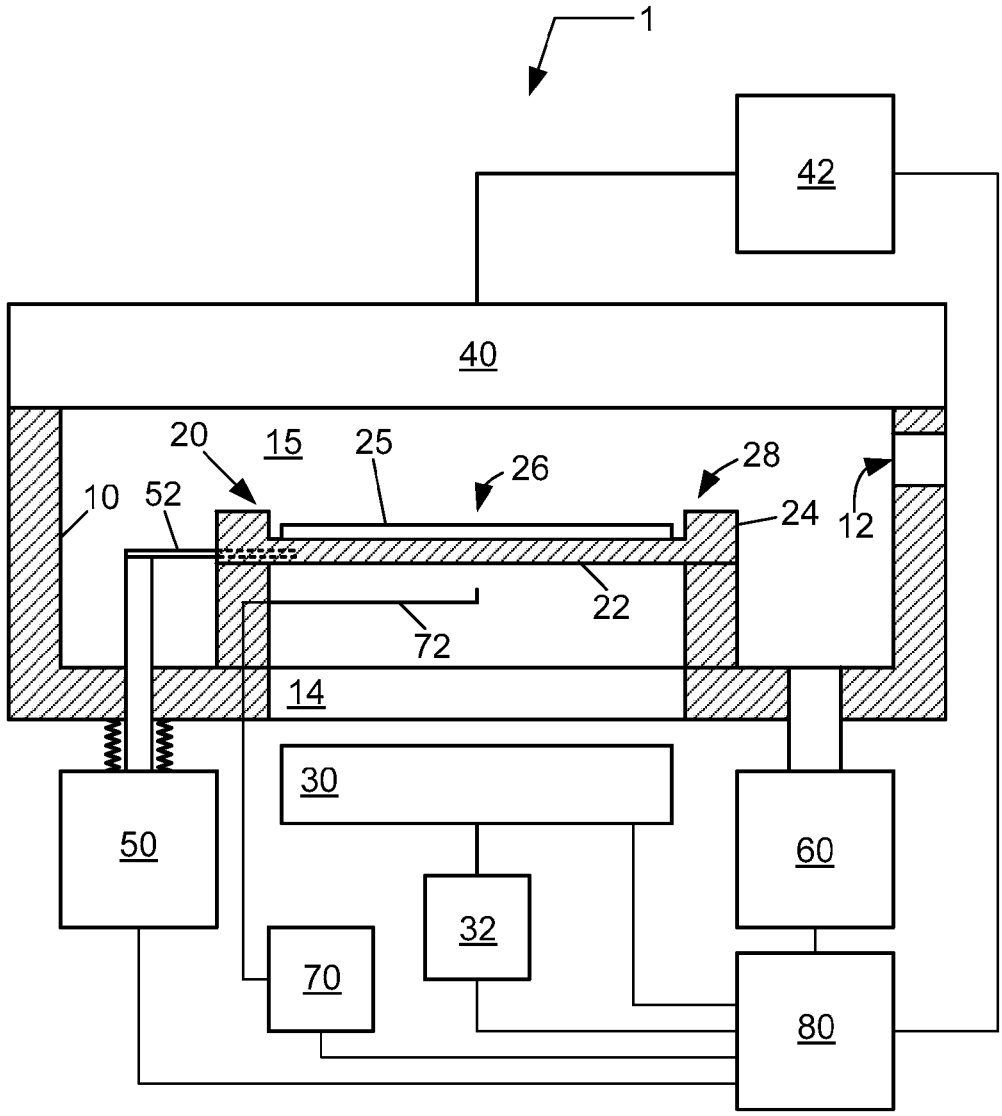
FIG. 1 is an illustration of a processing system according to an embodiment.

In the following description, for purposes of explanation and not limitation, specific details are set forth, such as a particular geometry of a processing system, descriptions of various components and processes used therein. However, it should be understood that the invention may be practiced in other embodiments that depart from these specific details.

Reference throughout this specification to "one embodiment" or "an embodiment" means that a particular feature, structure, material, or characteristic described in connection with the embodiment is included in at least one embodiment of the invention, but do not denote that they are present in every embodiment. Thus, the appearances of the phrases "in one embodiment" or "in an embodiment" in various places throughout this specification are not necessarily referring to the same embodiment of the invention. Furthermore, the particular features, structures, materials, or characteristics may be combined in any suitable manner in one or more embodiments. Various additional layers and/or structures may be included and/or described features may be omitted in other embodiments.

As described above, many processing parameters during various steps in semiconductor manufacturing play a vital role in the successful fabrication of robust, high performance electronic devices. A processing parameter of particular importance in a deposition process, an etch process, or other thermal process, is substrate temperature and its variation across the substrate. For example, chemical vapor deposition (CVD) is a technique conventionally used to deposit thin films, wherein substrate temperature is a critical processing parameter.

In a CVD process, a continuous stream of film precursor vapor is introduced to a process chamber containing a substrate, wherein the composition of the film precursor has the principal atomic or molecular species found in the film to be formed on the substrate. During this continuous process, the precursor vapor is chemisorbed on the surface of the substrate while it thermally decomposes and reacts with or without the presence of an additional gaseous component that assists the reduction of the chemisorbed material, thus, leaving behind the desired film.

Among other processing parameters, variations in substrate temperature may lead to variations in the deposition rate or film thickness. For example, in a kinetic-limited temperature regime, processing is typically characterized by a strong dependence of deposition rate on temperature. A kinetic-limited temperature regime refers to the range of deposition conditions where the deposition rate of a CVD process is limited by the kinetics of the chemical reactions at the substrate surface. Unlike the kinetic-limited temperature regime, a mass-transfer limited regime is normally observed at higher substrate temperatures and includes a range of deposition conditions where the deposition rate is limited by the flux of chemical reactants to the substrate surface. In either regime, the deposition rate depends on the substrate temperature; however, the level of dependence is greater for the kinetic-limited temperature regime.

Hence, the inventor recognizes the desire to produce a spatially uniform substrate temperature profile or to tailor the substrate temperature profile to counter the effects of other non-uniform processing parameters. More specifically, the inventor has observed a reduction in the deposition rate (or deposited film thickness) at locations on the substrate (to be discussed below), and they have attributed this reduction in the deposition rate to a corresponding measured reduction in the substrate temperature. The inventor believes the reduction in temperature to be associated with shadowing due to the location of an opaque object, such as a temperature measuring device, between a radiative heat source and the substrate being processed.

Therefore, referring now to the drawings, wherein like reference numerals designate identical or corresponding parts throughout the several views, FIG. 1 presents a processing system 1 according to an embodiment. The processing system 1 comprises a process chamber 10, a susceptor 20 mounted in the process chamber 10 and configured to support a substrate 25 within a process space 15, a substrate heating apparatus 30 configured to elevate a temperature of the susceptor 20, and a gas distribution system 40 configured to introduce a process gas to the process chamber 10 to facilitate film forming reactions at a surface of the substrate 25.

Additionally, the processing system 1 comprises a vacuum pumping system 60 coupled to the process chamber 10 and configured to evacuate the process chamber 10. Furthermore, a controller 70 is coupled to the process chamber 10, the susceptor 20, the substrate heating apparatus 30, the gas distribution system 40, and the vacuum pumping system 60, and may be configured to monitor, adjust and control the substrate temperature as will be further discussed below.

In the illustrated embodiment depicted in FIG. 1, the processing system 1 includes a deposition system and, more specifically, a thermal CVD (chemical vapor deposition) system. However, the processing system 1 may include other treatment systems. For example, processing system 1 may include an etch system configured to facilitate dry plasma etching, or, alternatively, dry non-plasma etching. Alternately, the processing system 1 includes a photo-resist coating chamber such as a heating/cooling module in a photo-resist spin coating system that may be utilized for post-adhesion bake (PAB) or post-exposure bake (PEB), etc.; a photo-resist patterning chamber such as a photo-lithography system; a dielectric coating chamber such as a spin-on-glass (SOG) or spin-on-dielectric (SOD) system; a deposition chamber such as a vapor deposition system, chemical vapor deposition (CVD) system, plasma enhanced CVD (PECVD) system, atomic layer deposition (ALD) system, plasma enhanced ALD (PEALD) system, or a physical vapor deposition (PVD) system; or a rapid thermal processing (RTP) chamber such as a RTP system for thermal annealing.

The susceptor 20 comprises a substrate support 22 comprising a central portion 26 and an edge portion 28, wherein the central portion 26 has a support surface configured to receive and support substrate 25, and the edge portion 28 extends beyond a peripheral edge of the substrate 25. The susceptor 20 further comprises an edge reflector 24 coupled to the edge portion of the substrate support 22 and configured to partially or fully shield the peripheral edge of the substrate 25 from radiative exchange with an outer region of the processing system 1. For example, the outer region of processing system 1 may include the process chamber 10. Further, in addition to shielding the edge of substrate 25, the edge reflector 24 may influence the substrate temperature at the edge of substrate 25 via radiative heating (i.e., if the temperature of the edge reflector 24 exceeds the substrate temperature at the edge of substrate 25).

The substrate heating apparatus 30 may comprise a radiative heat source for producing electromagnetic (EM) radiation including one or more lamps, such as a lamp array, configured to radiatively heat the susceptor 20 and/or substrate 25 by illuminating a backside of susceptor 20 through an optically transparent window 14. Alternatively, the substrate heating apparatus 30 may be oriented above the substrate 25 in order to directly heat substrate 25. The one or more lamps may comprise a tungsten-halogen lamp. Additionally, the one or more lamps may be coupled to a drive system 32 configured to rotate and/or translate the one or more lamps in order to adjust and/or improve radiative heating of the susceptor 20. Furthermore, the one or more lamps may be aligned relative to one another in such a way as to adjust and/or improve radiative heating of the susceptor 20.

To be discussed in greater detail below, the substrate heating apparatus 30 may further comprise a translucent object disposed between the radiative heat source and the substrate 25 along an EM wave path there between, and an opaque object disposed between the radiative heat source and the substrate 25 along the EM wave path there between. To reduce shadowing of the substrate by the opaque object, the translucent object comprises at least one textured surface to cause random refraction of the EM radiation passing through the translucent object, or an optical waveguide configured to encapsulate the opaque object and direct the EM radiation around the opaque object, or a combination thereof.

The opaque object may include one or more temperature measurement devices 72. The one or more temperature measurement devices 72 may be coupled to a temperature measurement system 70, and may include an optical temperature probe, such as an optical fiber thermometer, an optical pyrometer, a band-edge temperature measurement system as described in pending U.S. patent application Ser. No. 10/168,544, filed on Jul. 2, 2002, the contents of which are incorporated herein by reference in their entirety, or a thermocouple such as a K-type thermocouple. Examples of optical thermometers include: an optical fiber thermometer commercially available from Advanced Energies, Inc., Model No. OR2000F; an optical fiber thermometer commercially available from Luxtron Corporation, Model No. M600; or an optical fiber thermometer commercially available from Takaoka Electric Mfg., Model No. FT-1420.

The gas distribution system 40 may comprise a showerhead gas injection system having a gas distribution assembly, and one or more gas distribution plates coupled to the gas distribution assembly and configured to form one or more gas distribution plenums. Although not shown, the one or more gas distribution plenums may comprise one or more gas distribution baffle plates. The one or more gas distribution plates further comprise one or more gas distribution orifices to distribute a process gas from the one or more gas distribution plenums to the process space 15 within process chamber 10. Additionally, the gas distribution system 40 is coupled to a process gas supply system 42.

The process gas supply system 42 is configured to supply the process gas, which may include one or more film precursors, one or more reduction gases, one or more carrier gases, one or more inert gases, etc., to the gas distribution system 40. Further, the one or more film precursors may include a vapor derived from a liquid or solid-phase source. For example, the process gas supply system 42 may include a precursor vaporization system configured to evaporate a precursor in a liquid-phase or sublime a precursor in a solid-phase to form precursor vapor. The terms "vaporization," "sublimation" and "evaporation" are used interchangeably herein to refer to the general formation of a vapor (gas) from a solid or liquid precursor, regardless of whether the transformation is, for example, from solid to liquid to gas, solid to gas, or liquid to gas.

Furthermore, the processing system 1 comprises a lifting assembly 50 comprising three or more lifting elements 52 configured to vertically translate substrate 25 to and from the support surface of substrate support 22, and to and from a horizontal plane in process chamber 10 where substrate 25 may be transferred into and out of process chamber 10 through transfer slot 12. As shown in FIG. 1, each of the three or more lifting elements 52 may extend laterally through an opening in the edge reflector 24 to a recess positioned below the peripheral edge of substrate 25 in substrate support 22.

Alternatively, the lifting assembly may comprise three or more lift pins (not shown) configured to vertically translate substrate 25 to and from the support surface of substrate support 22, and to and from a horizontal plane in process chamber 10 where substrate 25 may be transferred into and out of process chamber 10 through transfer slot 12. Although not shown, the three or more lift pins may extend through openings in substrate support 22 and contact a bottom surface of substrate 25 when elevating and lowering substrate 25.

Vacuum pumping system 60 may include a turbo-molecular vacuum pump (TMP) capable of a pumping speed up to about 5000 liters per second (and greater) and a gate valve for throttling the chamber pressure. In conventional processing devices utilized for vacuum processing, a 1000 to 3000 liter per second TMP can be employed. TMPs are useful for low pressure processing, typically less than about 50 mTorr. For high pressure processing (i.e., greater than about 100 mTorr), a mechanical booster pump and dry roughing pump can be used. Furthermore, a device for monitoring chamber pressure (not shown) can be coupled to the process chamber 10. The pressure measuring device can be, for example, a Type 628B Baratron absolute capacitance manometer commercially available from MKS Instruments, Inc. (Andover, Mass.).

Controller 70 comprises a microprocessor, memory, and a digital I/O port capable of generating control voltages sufficient to communicate and activate inputs to processing system 1 as well as monitor outputs from processing system 1. Moreover, controller 70 can be coupled to and can exchange information with substrate heating apparatus 30, drive system 32, gas supply system 42, substrate lifting assembly 50, vacuum pumping system 60, and/or one or more temperature measurement devices (not shown). For example, a program stored in the memory can be utilized to activate the inputs to the aforementioned components of processing system 1 according to a process recipe in order to perform a vapor deposition process on substrate 25.

Controller 70 can be locally located relative to the processing system 1, or it can be remotely located relative to the processing system 1*a*. For example, controller 70 can exchange data with processing system 1 using a direct connection, an intranet, and/or the internet. Controller 70 can be coupled to an intranet at, for example, a customer site (i.e., a device maker, etc.), or it can be coupled to an intranet at, for example, a vendor site (i.e., an equipment manufacturer). Alternatively or additionally, controller 70 can be coupled to the internet. Furthermore, another computer (i.e., controller, server, etc.) can access controller 70 to exchange data via a direct connection, an intranet, and/or the internet.

Figure 2A:
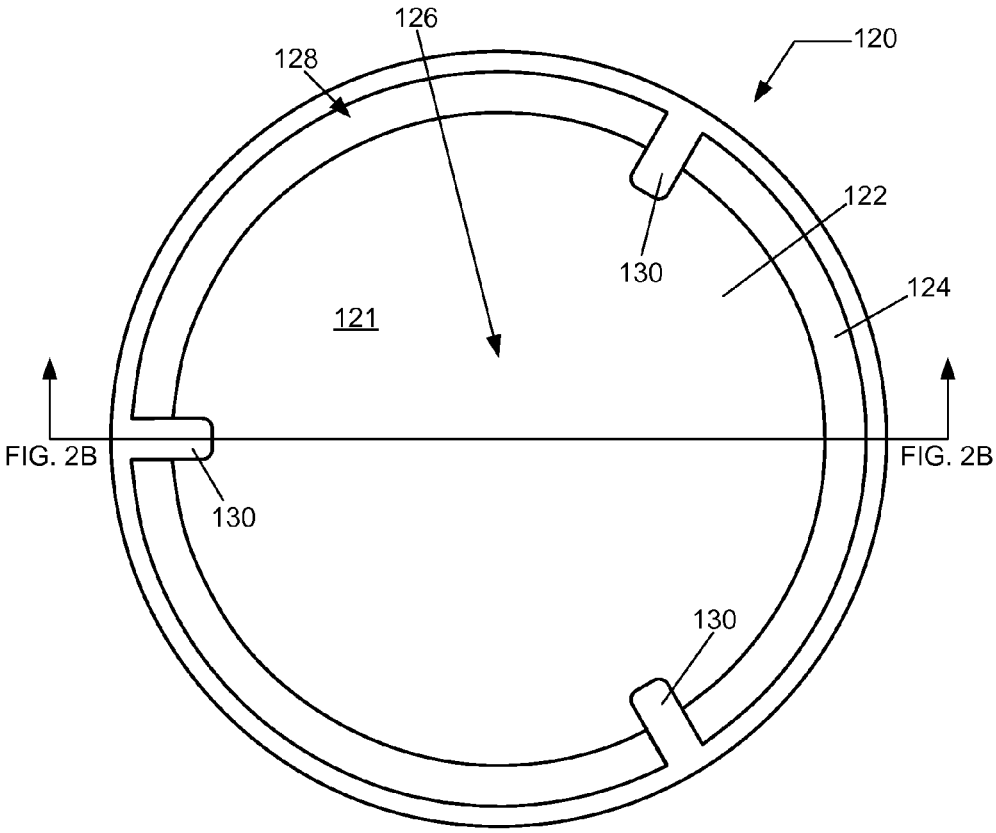
FIG. 2A provides a top view of a susceptor for use in a processing system.
Figure 2B:
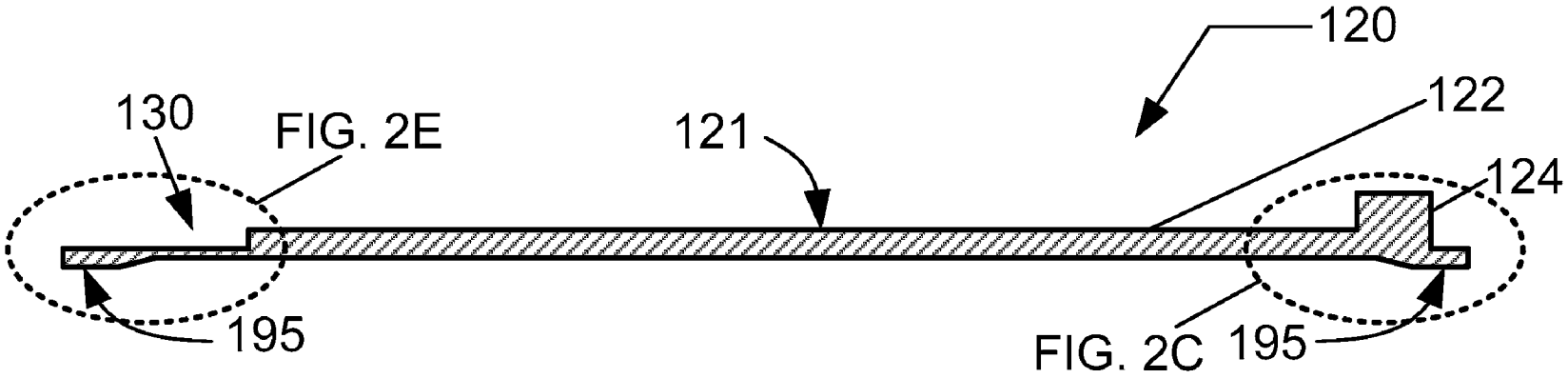
FIG. 2B provides a cross-sectional view of the susceptor depicted in FIG. 2A.
Figure 2C:
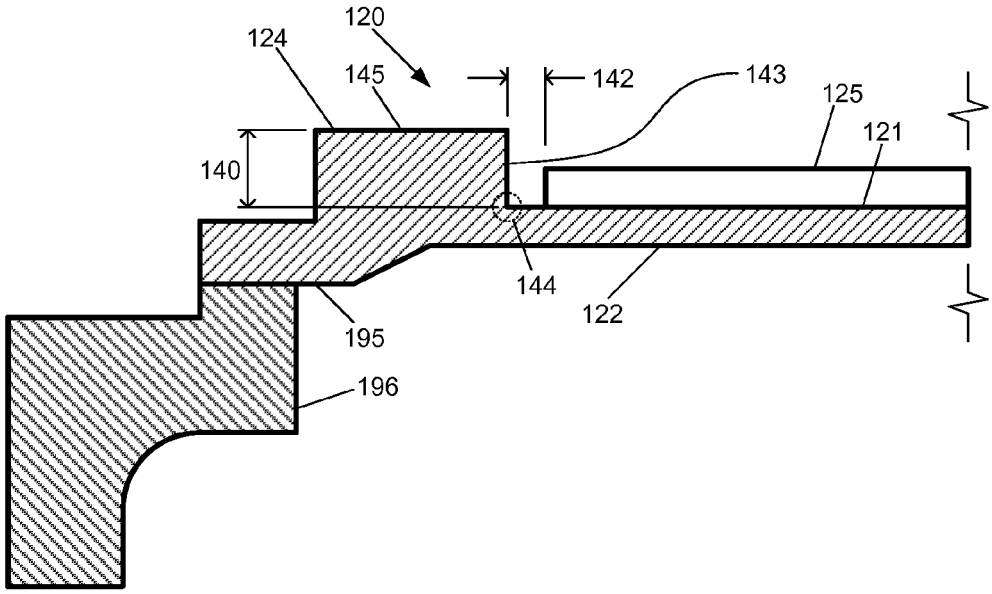
FIG. 2C shows an exploded, cross-sectional view of a portion of the susceptor depicted in FIG. 2B.
Figure 2D:
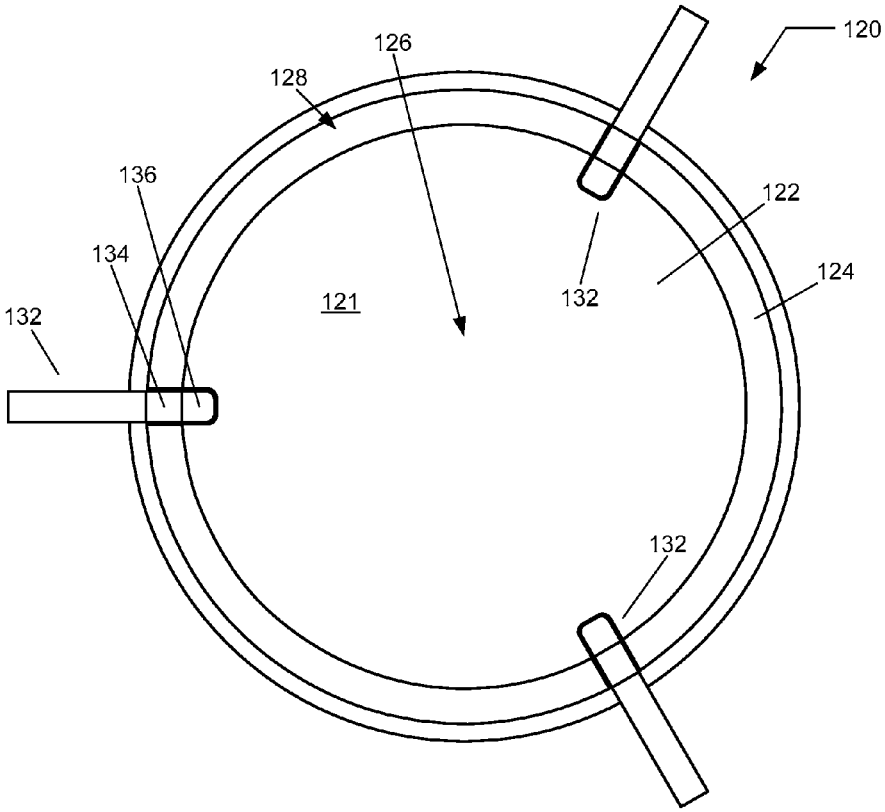
FIG. 2D provides another top view of the susceptor depicted in FIG. 2A.
Figure 2E:
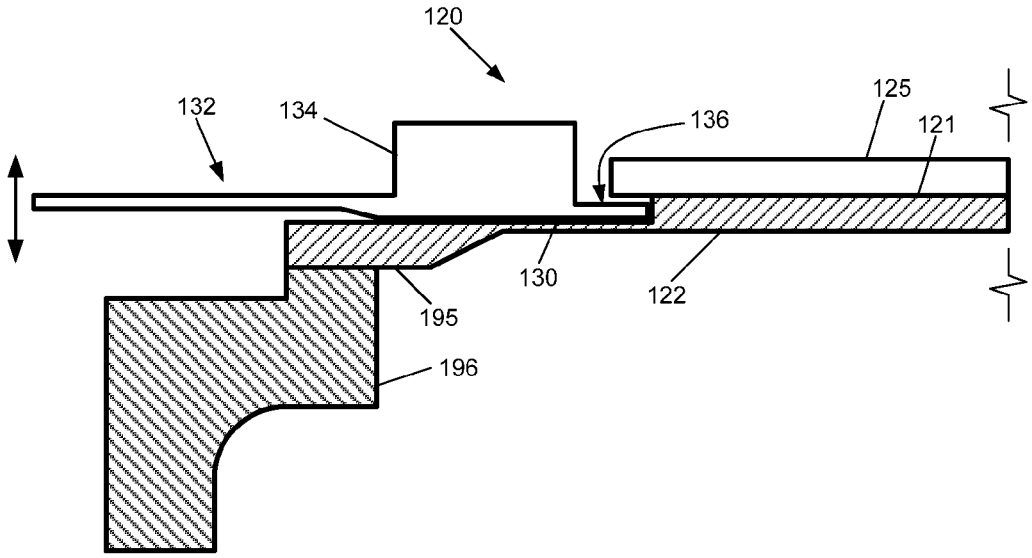
FIG. 2E shows an exploded, cross-sectional view of another portion of the susceptor depicted in FIG. 2B.

Referring now to FIGS. 2A through 2E, several views, including top views and cross-sectional views, of a susceptor 120 are provided according to an embodiment. FIGS. 2A and 2D provide a top view of susceptor 120 with and without the presence of lifting elements 132, respectively. FIG. 2B provides a cross-sectional view of susceptor 120 along the section line indicated in FIG. 2A. FIGS. 2C and 2D provide exploded cross-sectional views of different regions of susceptor 120 as indicated in FIG. 2B.

The susceptor 120 comprises a substrate support 122 comprising a central portion 126 and an edge portion 128, wherein the central portion 126 has a support surface 121 configured to receive and support a substrate 125, and the edge portion 128 extends beyond a peripheral edge of substrate 125. The susceptor 120 also comprises an edge reflector 124 coupled to the edge portion of the substrate support 122 and configured to partially or fully shield the peripheral edge of substrate from radiative exchange with an outer region of a processing system, such as processing system 1 in FIG. 1). In addition to shielding the edge of the substrate, the edge reflector 124 may influence the substrate temperature at the edge of the substrate via radiative heating (i.e., if the temperature of the edge reflector 124 exceeds the substrate temperature at the edge of the substrate). The susceptor 120 comprises a substrate support 122 configured for supporting a substrate having a circular geometry. However, the substrate support may be configured for other geometries including, for example, rectangular geometries.

As illustrated in FIG. 2C, an exploded cross-section view of susceptor 120 is provided. The susceptor 120 may be mounted within a process chamber, and supported at a base surface 195 by a chamber support structure 196. The susceptor 120 may or may not be affixed and/or fastened to the chamber support structure 196.

Additionally, as illustrated in FIG. 2C, the geometry of the edge reflector 124 may be characterized by a height 140 of the edge reflector 124, a lateral spacing 142 between the edge reflector 124 and the substrate 125, an orientation of an inner surface 143 of edge reflector 124, or a shape of corner region 144, or any combination of two or more thereof. The height 140 may be measured from a bottom surface of substrate 125 (or the support surface 121) to a top surface 145 of edge reflector 124. The lateral spacing 142 may be measured from a peripheral edge of substrate 125 to an inner surface 143 of edge reflector 124.

The height 140 of edge reflector 124 may be equivalent to a thickness of substrate 125. Alternatively, the height 140 may be about 1 mm (millimeter) or greater. Alternatively, the height 140 may be about 2 mm or greater. Alternatively, the height 140 may be about 3 mm or greater. Alternatively, the height 140 may be about 4 mm or greater. Alternatively, the height 140 may be about 5 mm or greater.

The orientation of the inner surface 143 may be such that it is substantially perpendicular to support surface 121. Further, the geometry of corner region 144 may be such that any fillet and/or angled corner/bevel is substantially reduced, eliminated, and/or minimized.

The lateral spacing 142 between edge reflector 124 and substrate 125 may be 2 mm or less. Alternatively, the lateral spacing 142 between edge reflector 124 and substrate 125 may be 1 mm or less. Alternatively, the lateral spacing 142 between edge reflector 124 and substrate 125 may be 0.5 mm or less.

The geometry of the edge reflector 124 may further be characterized by an aspect ratio of the height 140 of edge reflector 124 to the lateral spacing 142 between edge reflector 124 and substrate 125. The aspect ratio may be greater than or equal to about 1:1. Alternatively, the aspect ratio may be greater than or equal to about 2:1. Alternatively, the aspect ratio may be greater than or equal to about 4:1.

As shown in FIG. 2B, the susceptor 120 may comprise a monolithic component. For example, the substrate support 122 and the edge reflector 124 are fabricated from a single piece of material, or are adjoined and/or fused via a sintering process, a brazing process, or a welding process. The substrate support 122 or the edge reflector 124 or both may comprise a ceramic or a metal coated with a ceramic. The substrate support 122 or the edge reflector 124 or both may comprise an oxide, a nitride, a carbide, or any combination of two or more thereof. For example, the substrate support 122 or the edge reflector 124 may be composed of silicon carbide.

Referring again to FIGS. 2A through 2E, a lifting assembly comprising three or more lifting elements 132 (FIGS. 2D, 2E) is shown that is configured to vertically translate substrate 125 (FIGS. 2C, 2E) to and from the support surface 121 (FIGS. 2A-2E) of substrate support 122 (FIGS. 2A-2E). Each of the three or more lifting elements 132 may extend laterally through an opening in the edge reflector 124 to a recess 130 (FIGS. 2B, 2E) positioned below the peripheral edge of substrate 125 in substrate support 122. Furthermore, each of the three or more lifting elements 132 comprises a lifting support surface 136 (FIGS. 2D, 2E) configured to contact a bottom surface of substrate 125 when lifting substrate 125, and a reflector portion 134 (FIGS. 2D, 2E) that aligns and fills the opening in the edge reflector 124 to create a continuous reflector surrounding substrate 125 when not lifting substrate 125.

Figure 3:
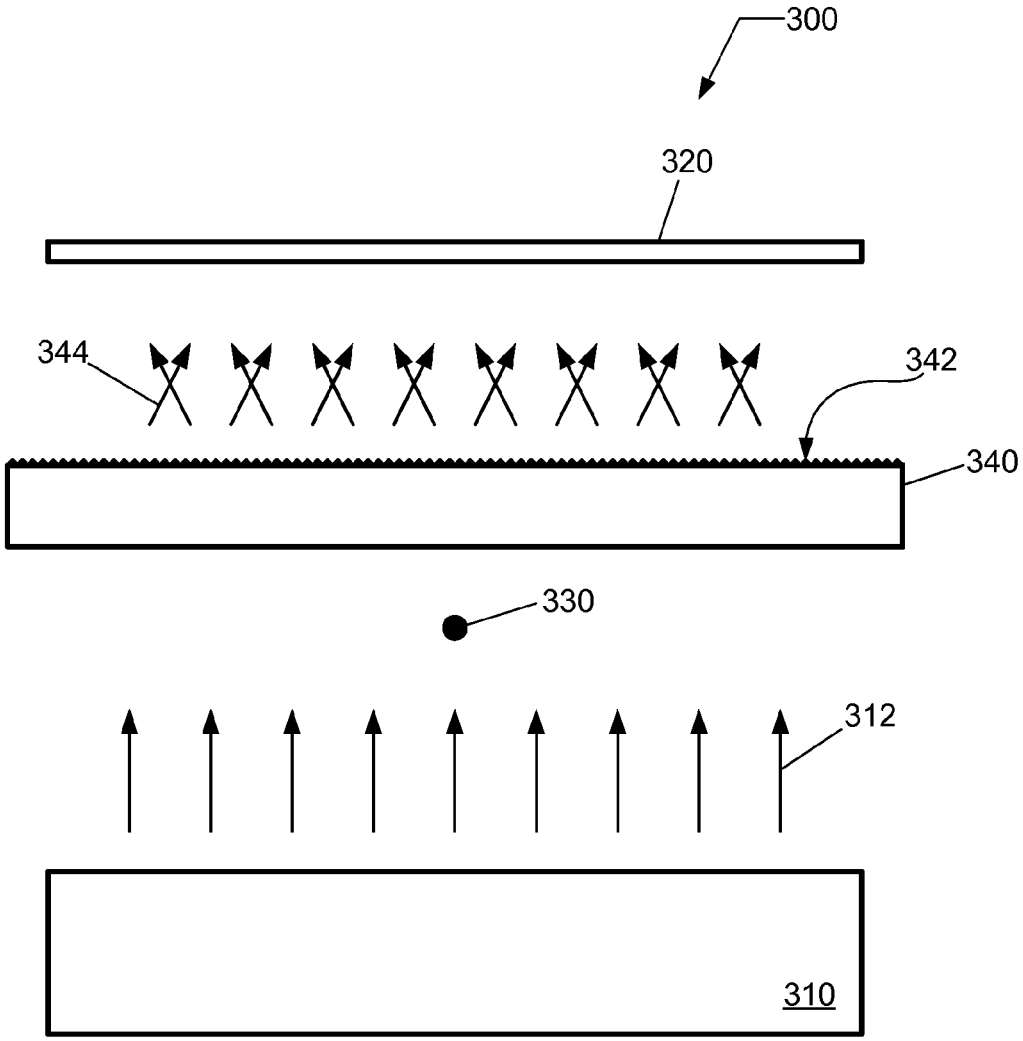
FIG. 3 provides a cross-sectional view of a substrate heating apparatus according to an embodiment.

Referring now to FIG. 3, a simplified schematic representation of a substrate heating apparatus 300 is provided according to an embodiment. The substrate heating apparatus 300 comprises a radiative heat source 310 coupled to a processing system and configured to produce electromagnetic (EM) radiation 312 for radiative heating of a substrate 320. The substrate heating apparatus 300 further comprises a translucent object 340 disposed between the radiative heat source 310 and the substrate 320 along an EM wave path there between, and an opaque object 330 disposed between the radiative heat source 310 and the substrate 320 along the EM wave path there between.

The opaque object 330 may comprise a temperature measurement device, such as a thermocouple or an optical temperature probe. Although only one opaque object 330 is shown, a plurality of opaque objects may be present that obstruct EM radiation 312 and cause shadowing of substrate 320. As shown in FIG. 3, the translucent object 340 may be disposed between substrate 320 and opaque object 330. Alternatively, the translucent object 340 may be disposed between radiative heat source 310 and opaque object 330. The translucent object 340 may include a plate, window, and/or lens constructed of an optically transparent material. In particular, the material composition of the translucent object 340 may be selected to achieve relatively high transmittance (or low absorption) in the infrared (IR) spectrum. For example, the translucent object 340 may be fabricated from quartz or sapphire.

The translucent object 340 further comprises at least one textured surface 342 to cause random refraction of the EM radiation 312 passing through the translucent object 340. The incoming EM radiation 312, after random refraction caused by the translucent object 340, forms randomly refracted EM radiation 344. The at least one textured surface 342 may comprise random roughness, or patterned roughness, or a combination thereof. For example, the patterned roughness may include ordered arrays of one or more features, including lines, grooves, channels, blind holes, dimples, etc.

The at least one textured surface 342 may be characterized by a roughness ranging from 0.5 micron to 10000 microns. Alternatively, the at least one textured surface 342 may be characterized by a roughness ranging from 0.5 micron to 1000 microns. Alternatively, the at least one textured surface 342 may be characterized by a roughness ranging from 0.5 micron to 100 microns. Alternatively, the at least one textured surface 342 may be characterized by a roughness ranging from 0.5 micron to 10 microns. Alternatively, the at least one textured surface 342 may be characterized by a roughness ranging from 0.5 micron to 1 micron. The roughness may include an average roughness ($R_a$) or a root mean square roughness ($R_q$), as defined by ANSI standard ANSI/ASME B46.1. Alternatively, the roughness may be based on another geometric (e.g., maximum peak, maximum valley, etc.) and/or statistical property (e.g., skewness, kurtosis, etc.).

Figure 4:
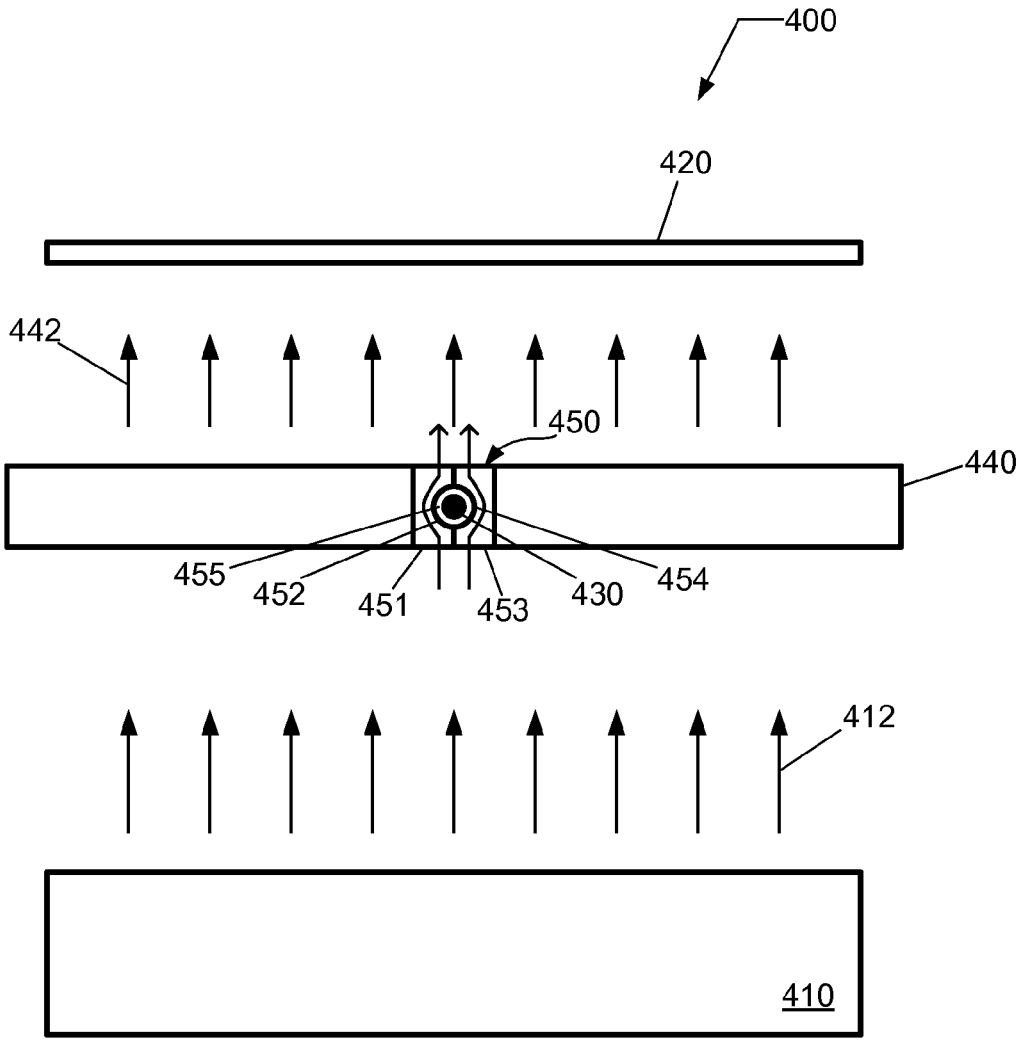
FIG. 4 provides a cross-sectional view of a substrate heating apparatus according to another embodiment.

Referring now to FIG. 4, a simplified schematic representation of a substrate heating apparatus 400 is provided according to an embodiment. The substrate heating apparatus 400 comprises a radiative heat source 410 coupled to a processing system and configured to produce electromagnetic (EM) radiation 412 for radiative heating of a substrate 420. The substrate heating apparatus 400 further comprises a translucent object 440 disposed between the radiative heat source 410 and the substrate 420 along an EM wave path there between, and an opaque object 430 disposed between the radiative heat source 410 and the substrate 420 along the EM wave path there between.

The opaque object 430 may comprise a temperature measurement device, such as a thermocouple or an optical temperature probe. Although only one opaque object 430 is shown, a plurality of opaque objects may be present that obstruct EM radiation 412 and cause shadowing of substrate 420. As shown in FIG. 4, the opaque object 430 may be embedded within the translucent object 440. The translucent object 440 may include a plate, window, and/or lens constructed of an optically transparent material. In particular, the material composition of the translucent object 440 may be selected to achieve relatively high transmittance (or low absorption) in the infrared (IR) spectrum. For example, the translucent object 440 may be fabricated from quartz or sapphire.

As shown in FIG. 4, the translucent object 440 further comprises an optical waveguide 450 configured to encapsulate the opaque object 430 and direct the EM radiation 442 around the opaque object 430. The optical waveguide 450 may include a first translucent member 451 having a first concave surface 452, and a second translucent member 453 having a second concave surface 454. The first translucent member 451 is configured to mate with the second translucent member 453 such that the first concave surface 452 faces the second concave surface 454 and defines a void 455 there between to receive and/or encapsulate the opaque object 430.

The translucent object 440 includes a recess, wherein the optical waveguide 450 is configured to insert within and provide a reflective interface between an outer surface of the optical waveguide 450 and the translucent object 440.

Figure 5:
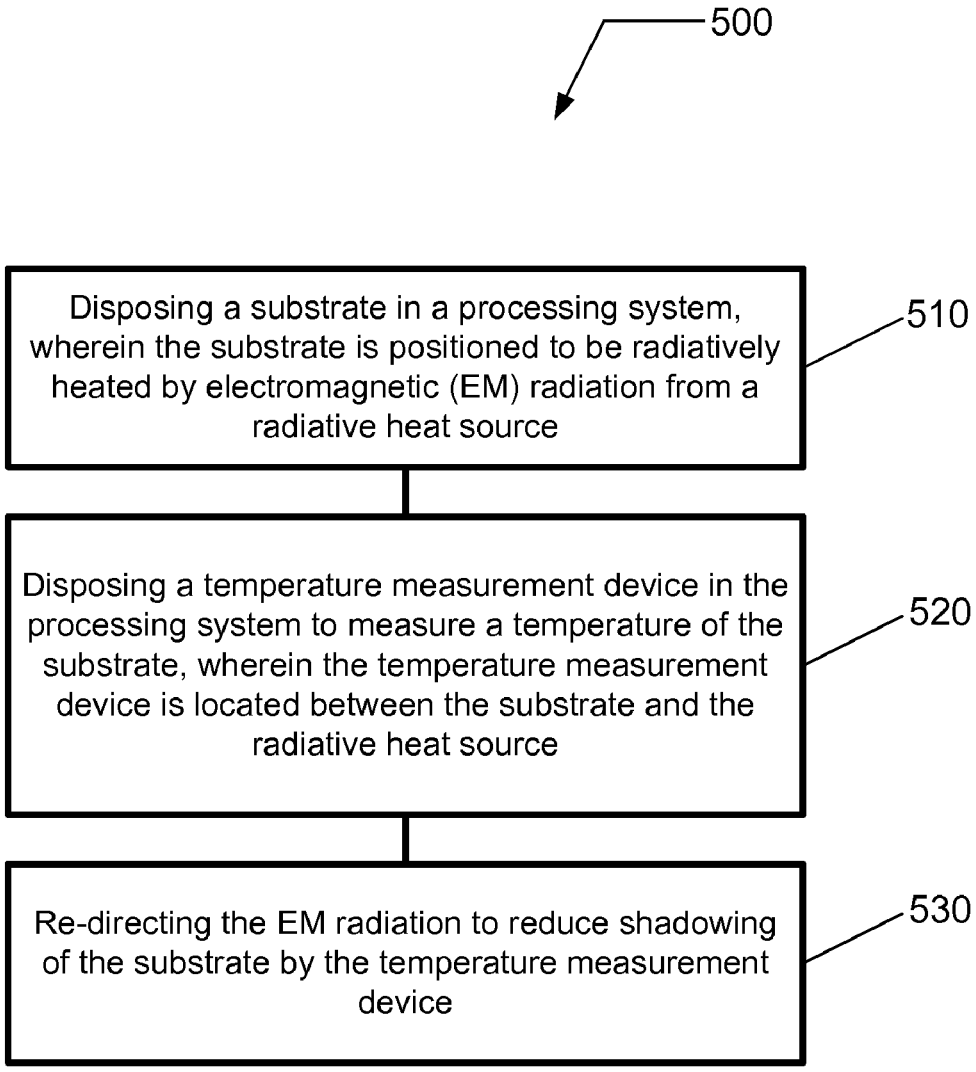
FIG. 5 provides a flow chart for illustrating a method of treating a substrate according to yet another embodiment.

In FIG. 5, a method of treating a substrate is described according to yet another embodiment. The method comprises a flow chart 600 beginning in 610 with disposing a substrate in a processing system, wherein the substrate is positioned to be radiatively heated by electromagnetic (EM) radiation from a radiative heat source. The processing system may include the system described in FIG. 1, or any one of the processing systems described above.

In 520, a temperature measurement device is disposed in the processing system to measure a temperature of the substrate, wherein the temperature measurement device is located between the substrate and the radiative heat source.

In 530, the EM radiation from the radiative heat source is re-directed to reduce shadowing of the substrate by the temperature measurement device.

Although only certain embodiments of this invention have been described in detail above, those skilled in the art will readily appreciate that many modifications are possible in the embodiments without materially departing from the novel teachings and advantages of this invention. Accordingly, all such modifications are intended to be included within the scope of this invention.

The invention claimed is:

1. A substrate heating apparatus, comprising:

a radiative heat source coupled to a processing system and configured to produce electromagnetic (EM) radiation for heating a substrate disposed in said processing system;

a translucent object disposed between said radiative heat source and said substrate along an EM wave path there between; and an opaque object disposed between said radiative heat source and said substrate along said EM wave path there between, wherein:

said translucent object comprises at least one textured surface to cause random refraction of said EM radiation passing through said translucent object, or said translucent object comprises an optical waveguide configured to encapsulate said opaque object and direct said EM radiation around said opaque object, or a combination thereof.

2. The substrate heating apparatus of claim 1, wherein said opaque object comprises a temperature measurement device.

3. The substrate heating apparatus of claim 2, wherein said temperature measurement device comprises a thermocouple or an optical temperature probe.

4. The substrate heating apparatus of claim 1, further comprising:

an optical window, separate from said translucent object, disposed between said radiative heat source and said substrate along said EM wave path there between, and configured to provide a vacuum seal with said processing system.

5. The substrate heating apparatus of claim 1, wherein said translucent object is disposed between said substrate and said opaque object.

6. The substrate heating apparatus of claim 1, wherein said textured surface comprises random roughness, or patterned roughness, or a combination thereof.

7. The substrate heating apparatus of claim 1, wherein said textured surface is characterized by a roughness ranging from 0.5 micron to 10000 microns.

8. The substrate heating apparatus of claim 1, wherein said textured surface is characterized by a roughness ranging from 0.5 micron to 100 microns.

9. The substrate heating apparatus of claim 1, wherein said textured surface is characterized by a roughness ranging from 0.5 micron to 10 microns.

10. The substrate heating apparatus of claim 1, wherein said optical waveguide comprises:

a first translucent member having a first concave surface; and a second translucent member having a second concave surface, said first translucent member configured to mate with said second translucent member such that said first concave surface faces said second concave surface and defines a void there between to receive said opaque object.

11. The substrate heating apparatus of claim 10, wherein said optical waveguide is configured to insert within said translucent object and provide a reflective interface between an outer surface of said optical waveguide and said translucent object.

12. The substrate heating apparatus of claim 1, further comprising:

a susceptor having a support surface to support said substrate.

13. The substrate heating apparatus of claim 12, wherein said susceptor is disposed between said substrate and said EM radiation source.

14. The substrate heating apparatus of claim 12, wherein said susceptor is composed of an oxide, a nitride, a carbide, or any combination of two or more thereof.

15. The substrate heating apparatus of claim 12, further comprising:

a lifting assembly comprising three or more lift pins configured to vertically translate said substrate to and from said support surface of said substrate support, said three or more lift pins extend through openings in said substrate support and contact a bottom surface of said substrate when elevating and lowering said substrate.

16. The substrate heating apparatus of claim 12, further comprising:

a lifting assembly comprising three or more lifting elements configured to vertically translate said substrate to and from said support surface of said susceptor, wherein each of said three or more lifting elements extends laterally into a recess positioned below a peripheral edge of said substrate in said susceptor, and wherein each of said three or more lifting elements comprises a lifting support surface configured to contact a bottom surface of said substrate when lifting said substrate.

17. The substrate heating apparatus of claim 1, wherein said radiative heat source comprises a lamp array that is configured to rotate.

18. The substrate heating apparatus of claim 1, wherein said material processing system comprises an etching system, a deposition system, or a thermal treatment system.

19. A processing system, comprising:

a process chamber;

a susceptor coupled to said process chamber and configured to support a substrate;

a substrate heating apparatus coupled to said processing system and configured to radiatively heat said substrate, comprising:

a radiative heat source configured to produce electromagnetic (EM) radiation;

a translucent object disposed between said radiative heat source and said substrate along an EM wave path there between; and an opaque object disposed between said radiative heat source and said substrate along said EM wave path there between, wherein:

said translucent object comprises at least one textured surface to cause random refraction of said EM radiation passing through said translucent object, or said translucent object comprises an optical waveguide configured to encapsulate said opaque object and direct said EM radiation around said opaque object, or a combination thereof; and a gas distribution system configured to introduce a process gas to said process chamber to facilitate film forming reactions at a surface of said substrate.

20. The processing system of claim 19, wherein said radiative heat source comprises a lamp array that is configured to rotate.

* * * * *